United States Patent [19]

Taguchi et al.

[11] Patent Number: 4,720,278

[45] Date of Patent: Jan. 19, 1988

[54] TRIMMING DEVICE FOR MARINE PROPULSION UNIT

[75] Inventors: Michihiro Taguchi; Yoshihiro Nagata, both of Hamamatsu, Japan

[73] Assignee: Sanshin Kogyo Kabushiki Kaisha, Japan

[21] Appl. No.: 1,016

[22] Filed: Jan. 7, 1987

[30] Foreign Application Priority Data

Jan. 17, 1986 [JP] Japan ..... 61-7728

[51] Int. Cl.[4] ..... B63H 5/12

[52] U.S. Cl. ..... 440/61; 440/53

[58] Field of Search ..... 440/53, 57, 61, 62, 440/63, 76, 77, 78; 92/165 PR, 121, 167; 403/114, 116, 122; 384/206, 209

[56] References Cited

U.S. PATENT DOCUMENTS

| | | | |
|---|---|---|---|
| 3,175,529 | 3/1965 | Bergstedt | 440/61 |
| 3,722,455 | 3/1973 | Carpenter | 440/61 |
| 4,055,385 | 10/1977 | Bjors | 403/114 |
| 4,645,463 | 2/1987 | Arneson | 440/57 |

*Primary Examiner*—Sherman D. Basinger
*Assistant Examiner*—Edwin L. Swinehart
*Attorney, Agent, or Firm*—Ernest A. Beutler

[57] ABSTRACT

A number of embodiments of trimming devices for marine propulsion units wherein there is provided an arrangement for improving the contact area between the thrust member and the outboard drive member and wherein sliding movement is minimized through pivotal support of one of the bearing elements. In some embodiments, the bearing elements have cooperating complementary curved surfaces and, in other embodiments, one surface is curved and the other is not. An improved arrangement is also disclosed for facilitating replacement of worn elements.

16 Claims, 7 Drawing Figures

Fig-1
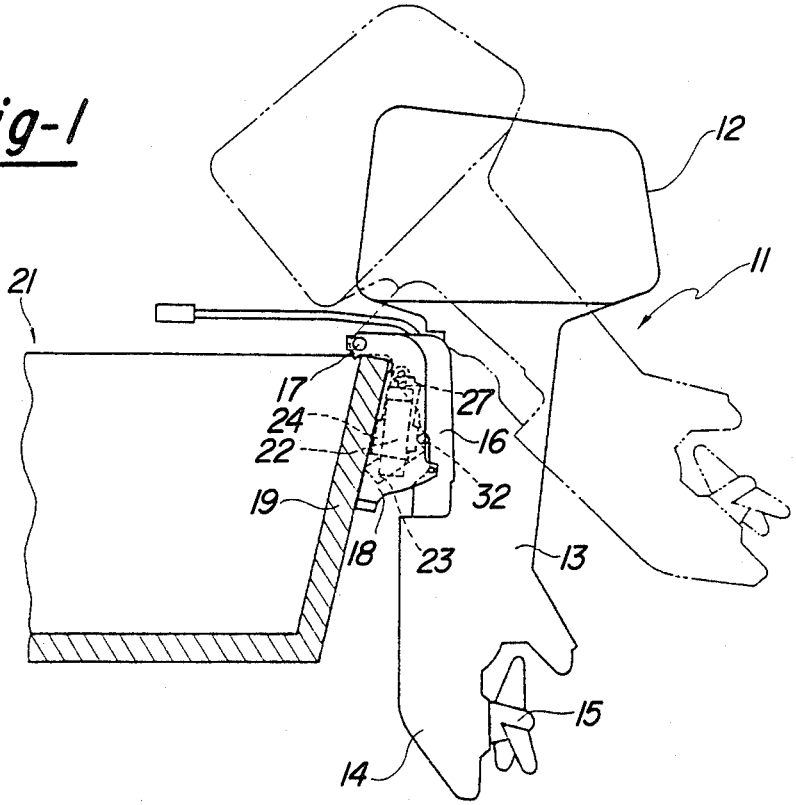
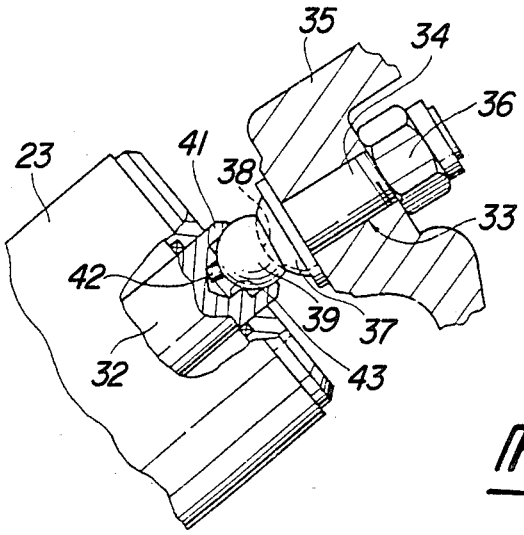
Fig-3

TRIMMING DEVICE FOR MARINE PROPULSION UNIT

BACKGROUND OF THE INVENTION

This invention relates to a trimming device for a marine propulsion unit and more particularly to an improved connection between the trim unit and the outboard drive.

In a wide variety of outboard drives, both outboard motors and the outboard drive section of an inboard/-outboard drive, there is an arrangement incorporated for adjusting the trim position of the pivotally supported outboard drive. In one form of powered trim adjustment, a trim cylinder is carried by the transom of the watercraft and has an actuating rod or thrust member that engages the outboard drive and which urges it about its pivotal axis to change the trim position. In addition, the thrust member of the trim unit takes the driving thrust from the outboard drive during forward propulsion. Normally, the thrust member reciprocates along a fixed axis whereas the outboard drive pivots about a fixed axis. As a result of this, there will be relative movement between the thrust member and the outboard drive that can result in wear, galling and other unsatisfactory conditions. In addition, such relative movement causes noise during operation.

It has been proposed to relieve the aforenoted condition through the use of a ball or roller member that is carried by the trim thrust member and which engages the outboard drive for effecting its pivotal movement. Although such roller members have some advantages, they have the disadvantage of providing a very small contact area and, therefore, a very high unit stress at the point of force transmission. Therefore, this solution can, at times, aggravate the galling and wear situation rather than reducing it.

It is, therefore, a principal object of this invention to provide an improved thrust and trimming device for a marine propulsion unit wherein wear is reduced.

It is a further object of this invention to provide a thrust taking arrangement for a trimming unit of a marine propulsion device wherein the contact area for force transmission is substantially increased thus reducing unit loading.

It is a further object of this invention to provide a simple and yet effective arrangement for transmission thrust between a thrust member and the outboard drive of a marine propulsion unit.

In connection with trimming devices of the type described, it is obvious that wear will be an eventual outcome regardless of the design of the system. Of course, it is desirable to construct the arrangement so that wear will be minimized but also it should be insured that replacement of worn components can be easily effected.

It is, therefore, yet another object of this invention to provide an improved arrangement for a trimming device for a marine propulsion unit wherein worn components can be easily serviced.

SUMMARY OF THE INVENTION

This invention is adapted to be embodied in a trim arrangement for a marine outboard drive that includes an outboard drive member that is mounted for pivotal movement through a plurality of trim adjusted positions relative to a transom of an associated watercraft. A trim motor is fixed relative to the transom and has a reciprocating thrust member that is adapted to bear against the outboard drive member for effecting pivotal movement of the outboard drive member relative to the transom upon reciprocation of the thrust member.

In accordance with a first feature of the invention, means are provided for minimizing the sliding forces between the thrust member and the outboard drive member. This means comprises a convex bearing element carried by one of the members and a cooperating bearing element carried by the other of the members and engaged with the convex bearing element. At least one of the bearing elements is supported for tilting movement relative to its supporting member for minimizing relative movement between the elements upon trim adjustment of the outboard drive.

In accordance with another feature of the invention, means are also provided for minimizing the forces between the thrust member and the outboard drive member. This means comprises a convex bearing element that is supported by one of the members and which is readily detachable from it for replacement purposes.

BRIEF DESCRIPTION OF THE DRAWINGS

FIG. 1 is a partial side elevational view of an outboard motor attached to the transom of a watercraft (shown partially and in section) illustrating a first embodiment of the invention.

FIG. 3 is a partial, enlarged view showing the thrust taking arrangement of the trim mechanism of this embodiment of the invention.

DETAILED DESCRIPTION OF THE PREFERRED EMBODIMENTS

Figure 2:
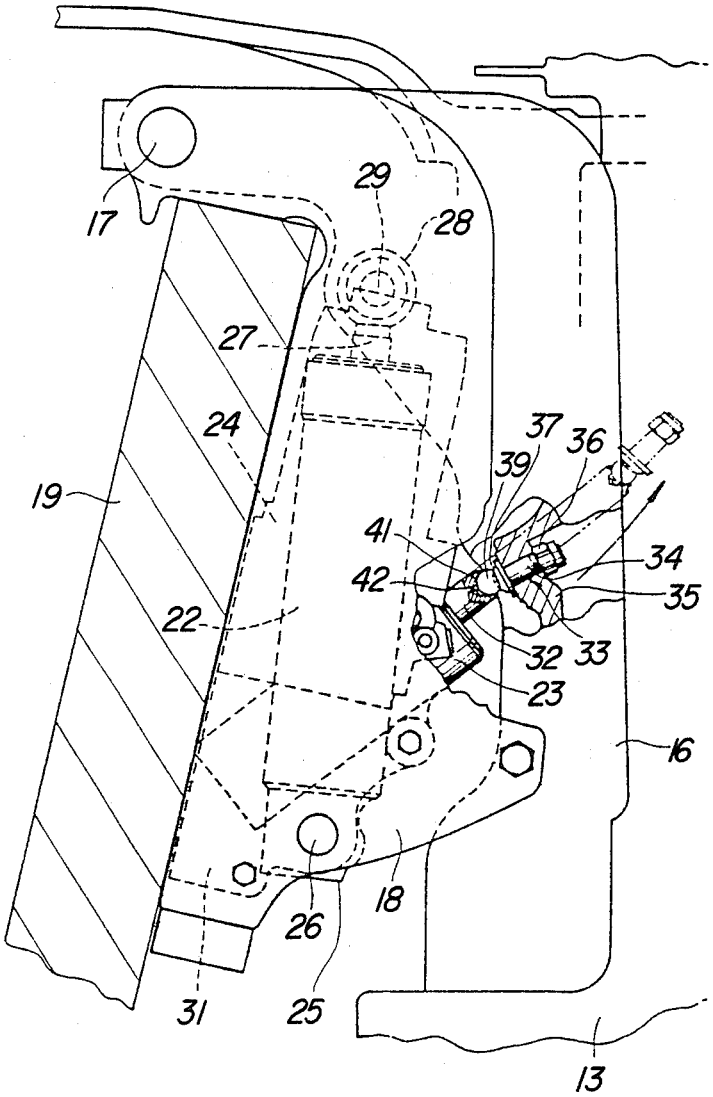
FIG. 2 is an enlarged side elevational view, with a portion broken away, showing the tilt and trim adjusting mechanism.

Referring first to FIG. 1, the general environment in which the invention may be practiced is illustrated. An outboard motor, indicated generally by the reference numeral 11, comprises the outboard drive in this embodiment. The term "outboard drive" is utilized to describe either an outboard motor or the outboard drive portion of an inboard/outboard drive.

The outboard motor 11 includes a power head 12 from which a drive shaft housing 13 depends. A lower unit 14 is provided at the lower end of the drive shaft housing 13 and contains a propeller 15 that is driven in a known manner.

A steering shaft (not shown) is fixed in a known manner to the drive shaft housing 13 and is journaled for steering movement about a generally vertically extending axis within a swivel bracket 16. The swivel bracket 16 is, in turn, pivotally connected by means of a pivot pin 17 to a clamping bracket 18. The pivot pin 17 permits tilting movement of the outboard drive 11 about the horizontally disposed axis defined by the pivot pin 17 for either trim adjustment or for pivotal movement of the outboard drive 11 to a tilted up out of the water condition as shown in phantom in FIG. 1. The clamping bracket 18 is affixed to a transom 19 of a watercraft 21 in a known manner.

Tilting movement of the outboard drive 11 is controlled primarily by means of a tilt cylinder assembly 22 while the trim condition of the outboard drive 11 is controlled primarily by a trim cylinder assembly 23. The tilt cylinder assembly 22 and trim cylinder assembly 23 are both powered by means of fluid delivered by a fluid pump that is driven by a reversible electric motor 24 in a known manner. It is to be understood, however, that either or both of the assemblies 22 and 23 may be other than hydraulic motors and may comprise screw jacks or the like. The structure of the outboard drive 11 and its tilt and trim arrangement as thus far described may be considered to be conventional.

Referring now in detail to FIG. 2, the tilt cylinder assembly 22 includes a cylinder housing that is formed with trunnion 25 that is pivotally connected to the clamping bracket 18 by means of a pivot pin 26. The cylinder housing is divided into a pair of fluid chambers by a piston (not shown) to which a piston rod 27 is affixed. The piston rod 27 extends through the upper end of the cylinder housing and has affixed to it an eyelet 28 that is pivotally connected to the swivel bracket 16 by means of a pivot pin 29. It should be readily apparent, therefore, that extension and retraction of the piston rod 27 will effect pivotal movement of the swivel bracket 16 relative to the clamping bracket 18 for pivoting the outboard drive 11 about the pivot pin 17. The tilt cylinder assembly 22 is a high speed, low force fluid motor and is normally employed for pivoting the outboard drive 11 from a trim up condition to a tilted up out of the water condition, which, as has been noted, is shown in phantom in FIG. 1.

The trim cylinder assembly 23 is affixed to a bracket 31 that is carried by the clamping bracket 18. Like the tilt cylinder 22, the trim cylinder 23 includes a cylinder housing that is divided into an upper and lower section by a piston (not shown). The cylinder housing of the trim cylinder 23 is, however, rigidly affixed to the bracket 31.

A piston rod 32 is rigidly affixed to the piston of the trim cylinder assembly 23 and normally bears directly against the swivel bracket 16 for effecting its pivotal movement. Because the trim piston rod 32 reciprocates along a fixed axis while the swivel bracket 16 pivots about a spaced axis defined by the pivot pin 17, there occurs relative movement which can cause wear, galling and noise. In accordance with this invention, an anti-friction thrust arrangement, indicated generally by the reference numeral 33, is provided for transferring thrust forces between the piston rod 32 and the swivel bracket 16.

The thrust taking arrangement 33 includes a carrier member 34 which includes, in the illustrated embodiments, a shaft that is received within an appropriate opening formed in a thrust receiving portion 35 of the swivel bracket 16. A nut 36 cooperates with a threaded portion of the carrier member 34 for holding it in position.

The carrier member 34 is provided a bearing surface 37 that is, in this embodiment, a semi-spherical shape. This bearing surface 37 cooperates with a complementary, concave bearing surface 38 of an anti-friction member 39. The anti-friction member 39 is a generally ball shaped member, except for the concave surface 38, and is journaled within a pocket formed at the extension of the piston rod 32 and which is bounded by a retaining area 41. Hence, the ball 39 is free to pivot during the relative reciprocation.

The degree of pivotal movement of the ball 39 is limited by a cylindrical projection 42 that is contained within a cylindrical recess 43 formed at the base of the recess in which the ball 39 is received. It should be apparent that as the piston rod 32 of the trim cylinder 23 reciprocates, the ball 39 may pivot in its recess while the surfaces 38 and 37 maintain in full face to face contact so as to minimize any relative movement during this reciprocation while, at the same time, insuring a large contact area. Hence, the unit stresses with this type of arrangement will be substantially reduced from conventional arrangements wherein the ball is a complete ball and contacts a flat area. In order to insure long life, the cavity 43 and the cavity in which the ball 39 is received may be filled with a grease or lubricant.

Figure 4:
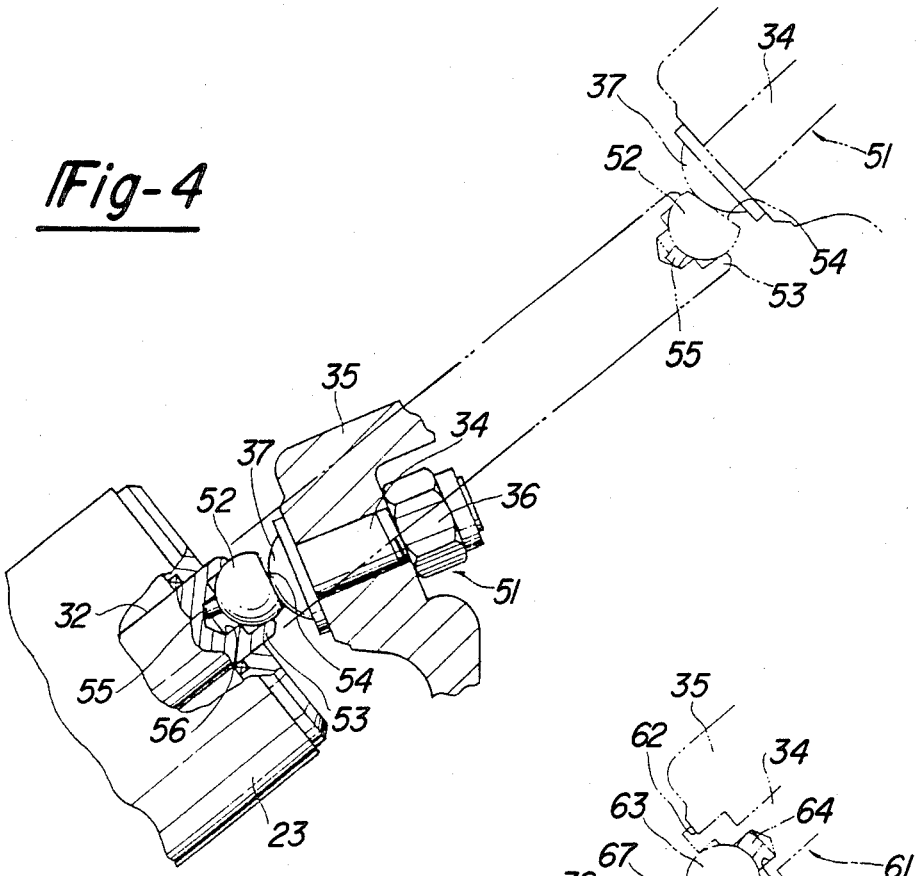
FIG. 4 is a cross-sectional view, in part similar to FIG. 3, showing another embodiment of the invention.

A thrust taking arrangement constructed in accordance with a second embodiment of the invention is shown in FIG. 4 and is identified generally by the reference numeral 51. In this embodiment, the carrier member 34 and its convex bearing surface 37 is the same as in the previously described embodiment and thus these components have been identified by the same reference numerals and will not be described again in detail.

In this embodiment, an anti-friction ball 52 is received within a cavity formed on an extension 53 of the piston rod 32. However, unlike the previously described embodiment, the ball 52 has a flat surface 54 that is engaged with the bearing surface 37. The ball 52 is pivotally journaled within the cavity defined by the projection 53 and the degree of pivotal movement is limited by means of a pin 55 that cooperates with a cylindrical bore 56 in the piston rod 32.

In this embodiment, the ball 52 can pivot during the reciprocating movement of the piston rod 32 so as to minimize wear and noise. Also, the amount of relative movement will be minimized and, even though the contact area is not as large as in the previously described embodiment, there will still be good operation and long life.

Figure 5:
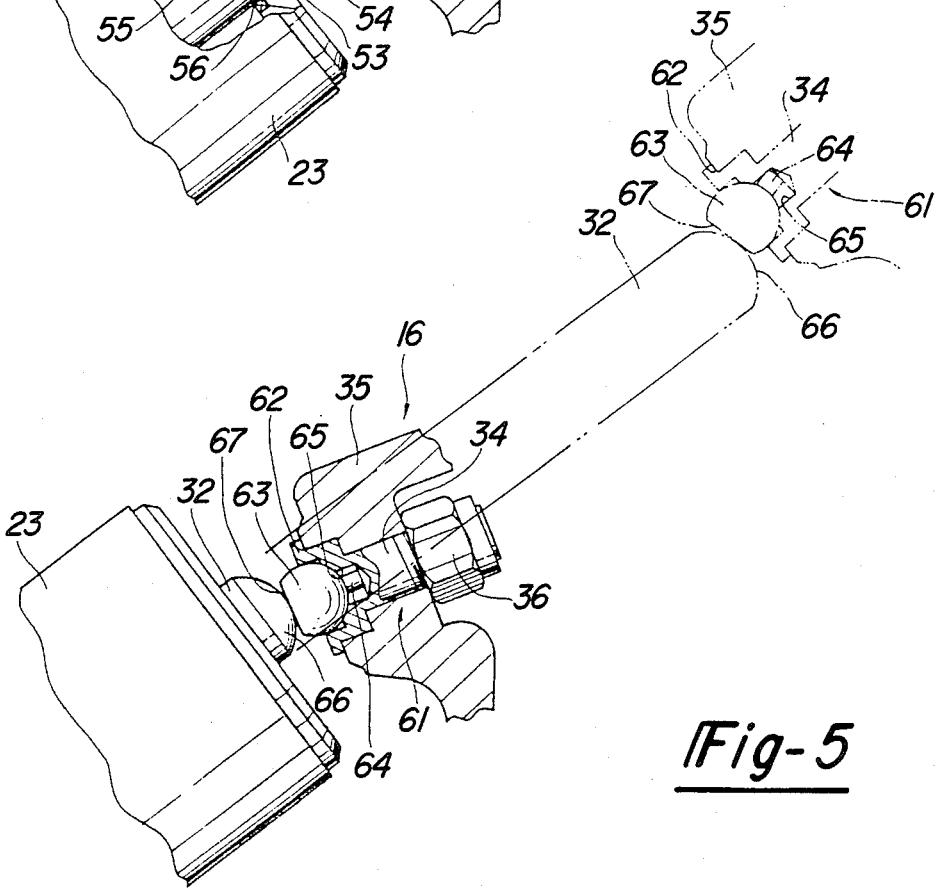
FIG. 5 is a cross-sectional view, in part similar to FIGS. 3 and 4, showing a further embodiment of the invention.

Referring to FIG. 5, yet another embodiment of an anti-friction connection is identified generally by the reference numeral 61. In this embodiment, the carrier member 34 is provided with a flanged extension 62 that defines a cavity in which an anti-friction ball 63 is positioned. The ball 63 has a cylindrical projection 64 that is received within a cavity 65 so as to limit the pivotal movement of the ball 63.

The piston rod 32 is provided with a spherical end portion 66 which is engaged with a flattened surface 67 of the ball 63. In this embodiment, reciprocation of the piston rod 32 causes the ball 63 to pivot in its supporting socket and reduce relative movement. Rather than being flattened, the ball 63 may be formed with a concave surface that is complementary in shape to the spherical surface 66 of the piston rod if further reductions in stresses and unit loading are required. In other regards, this embodiment achieves results similar to those as the previously described embodiments, as should be readily apparent to those skilled in the art.

Figure 6:
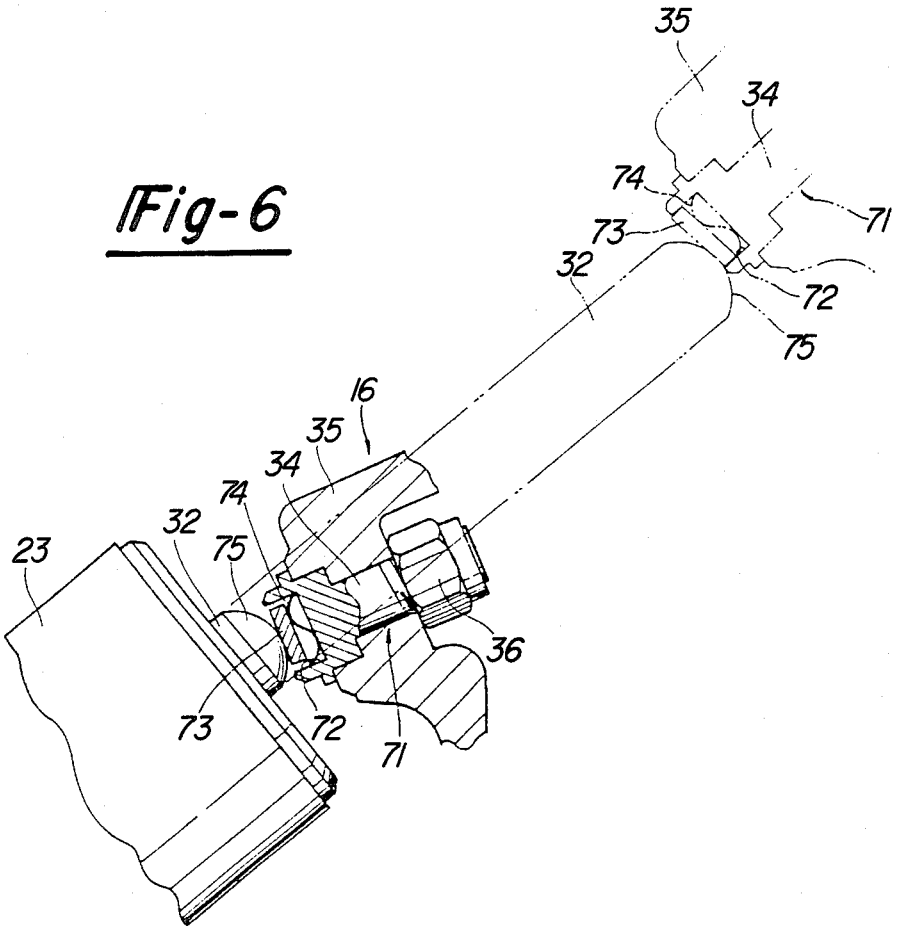
FIG. 6 is a cross-sectional view, in part similar to FIGS. 3, 4 and 5, showing yet another embodiment of the invention.

An anti-friction arrangement constructed with yet another embodiment of the invention is shown in FIG. 6 and is identified generally by the reference numeral 71. In this embodiment, the carrier member 34 is provided with an extension that defines a generally cylindrical recess 72 in which a plate-like anti-friction member 73 is received. A wave-type spring 74 is received at the base of the recess 72 and acts against the member 73 so as to urge it into contact with a spherical surface 75 of the piston rod 32. As seen in this figure, as the piston rod 32 extends, the member 73 may pivot through deflection of the wave spring 74 so as minimize the sliding contact between the surface 75 and the member 73 while at the same time maintaining a relatively good bearing area so as to minimize wear, galling and the other deleterious effects previously noted. If desired, the member 73 may have a concave surface complementary to the surface 75 if further reductions in unit stress are desired.

Figure 7:
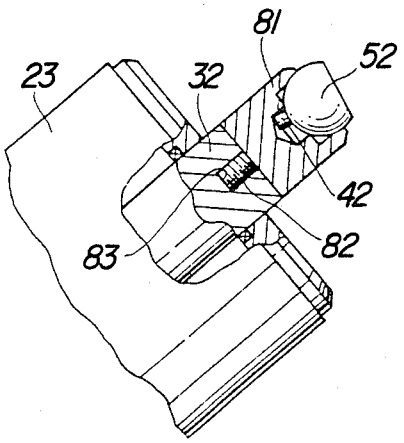
FIG. 7 is a partial cross-sectional view, in part similar to FIGS. 3 through 6, showing a still further embodiment of the invention.

FIG. 7 shows another embodiment of the invention. This embodiment is similar in general construction to the embodiment of FIG. 4 and, therefore, components of this embodiment which are substantially the same as those of that embodiment have been identified by the same reference numerals. In this embodiment, however, the ball 52 is mounted in a separate replaceable piece 81 which has a screw threaded extension 82 that is received within a complementary female threaded opening 83 of the piston rod 32 so that the member 81 and ball 52 may be replaced when worn. It should be understood that such a replaceable connection may also be utilized with an arrangement of the type shown in FIG. 1 through 3 or may be utilized in the embodiments of FIGS. 5 and 6 for replacing the pivotally supported element.

It should be readily apparent from the foregoing description that a number of embodiments of the invention have been illustrated and described and in which the relative contact area between the thrust member and the outboard drive member are improved and relative movement therebetween during tilting adjustment is minimized. Hence, wear and noise is minimized. In addition, replacement of worn components may also be facilitated. Although a number of embodiments of the invention have been illustrated and described, various changes and modifications may be made without departing from the spirit and scope of the invention, as defined by the appended claims.

We claim:

1. In a trim arrangement for a marine outboard drive member mounted for pivotal movement through a plurality of trim adjusted positions relative to a transom member of an associated watercraft and beyond said trim adjusted positions to a tilted up position, a trim motor fixed relative to one of the members and having a reciprocating thrust member adapted to bear against another of said members for effecting pivotal movement of said outboard drive member relative to the transom member upon reciprocation of said thrust member through the range of only said trim adjusted positions, and means for moving said outboard drive member beyond said trim adjusted positions to said tilted up position, the improvement comprising means for minimizing sliding forces between said thrust member and said another member during trim adjustment comprising a convex bearing element carried by one of said thrust member and said another member and a cooperating bearing element carried by the other of said thrust member and said another member and engaged with said convex bearing element, at least one of said bearing elements being supported for tilting movement relative to its supporting member for minimizing relative movement between said elements upon trim adjustment of said outboard drive member, said bearing elements being held in engagement only by the weight and thrust of said outboard drive member and being freely moveable away from contact with each other when said outboard drive member is moved to said tilted up position.

2. In a trim arrangement as set forth in claim 1 wherein the cooperating bearing element is pivotally supported.

3. In a trim arrangement as set forth in claim 2 wherein the cooperating bearing element has a flat surface engaged with the surface of the convex bearing element.

4. In a trim arrangement as set forth in claim 2 wherein the cooperating bearing element has a concave bearing surface that cooperates with the convex bearing element.

5. In a trim arrangement as set forth in claim 4 wherein the convex and concave surfaces have the same radii.

6. In a trim arrangement as set forth in claim 5 further including means for limiting the degree of pivotal movement of the cooperating bearing element.

7. In a trim arrangement as set forth in claim 1 wherein the convex bearing element is carried by the outboard drive member.

8. In a trim arrangement as set forth in claim 7 wherein the cooperating bearing element is pivotally supported.

9. In a trim arrangement as set forth in claim 1 wherein the convex bearing element is carried by the thrust member.

10. In a trim arrangement as set forth in claim 9 wherein the cooperating bearing element is pivotally supported.

11. In a trim arrangement as set forth in claim 2 wherein the cooperating bearing element is pivotally supported by a ball and socket connection.

12. In a trim arrangement as set forth in claim 11 wherein there are further provided means for limiting the pivotal movement of the cooperating bearing element.

13. In a trim arrangement as set forth in claim 2 wherein the cooperating bearing element comprises a disk-shaped element received within a recess of the other of the members and wherein a wave spring is positioned in said recess for permitting pivotal movement of sid disk-shaped element.

14. In a trim arrangement as set forth in claim 1 wherein one of the bearing elements is supported by a removable housing for facilitating service replacement.

15. In a trim arrangement as set forth in claim 14 wherein the bearing element supported for tilting movement is replaceable.

16. In a trim arrangement for a marine outboard drive member for pivotal movement through a plurality of trim adjusted positions relative to a transom member of an associated watercraft and beyond said trim adjusted positions to a tilted up position, a trim motor fixed relative to one of the members and having a reciprocating thrust member adapted to bear against another of said members for effecting pivotal movement of said outboard member relative to said transom member upon reciprocation of said thrust member through the range of only said trim adjusted positions, and means for moving said outboard drive member beyond said trim adjusted positions to said tilted up position, the improvement comprising anti-friction means interposed between said thrust member and said another member for reducing friction upon reciprocation of said thrust member, said anti-friction means comprising a pivotally supported bearing element and a removable housing for supporting said bearing element and detachably affixed to the another member, said bearing elements being held in engagement only by the weight and thrust of said outboard drive member and being freely moveable away from contact with each other when said outboard drive member is moved to said tilted up position.

* * * * *